US006616506B1

(12) United States Patent
Morrison et al.

(10) Patent No.: US 6,616,506 B1
(45) Date of Patent: Sep. 9, 2003

(54) INSERTED MOLDED TRACTION TIRE FOR A MODEL TOY TRAIN

(75) Inventors: James G. Morrison, Royal Oak, MI (US); Robert A. Grubba, Rochester Hills, MI (US)

(73) Assignee: Lionel L.L.C., Chesterfield, MI (US)

( * ) Notice: Subject to any disclaimer, the term of this patent is extended or adjusted under 35 U.S.C. 154(b) by 0 days.

(21) Appl. No.: 09/572,188

(22) Filed: May 17, 2000

(51) Int. Cl.[7] ..... A63H 19/02
(52) U.S. Cl. ..... 446/467; 446/465; 264/274
(58) Field of Search ..... 446/467, 465, 446/431, 470, 491; 264/274

(56) References Cited

U.S. PATENT DOCUMENTS 3,270,373 A * 9/1966 Jagger et al. ..... 264/274
3,398,222 A * 8/1968 Kaufman, Jr. et al. ..... 264/274
3,680,187 A * 8/1972 Murray ..... 264/274

* cited by examiner

*Primary Examiner*—Derris H. Banks
*Assistant Examiner*—Bera B. Miller
(74) *Attorney, Agent, or Firm*—Dykema Gossett PLLC

(57) ABSTRACT

The present invention provides a wheel assembly for a model toy train wherein the wheel assembly includes a wheel and a traction tire. The wheel including an undercut recess and at least one sprue. The traction tire is molding into the undercut recess through the sprue.

18 Claims, 1 Drawing Sheet

FIG-1
PRIOR ART
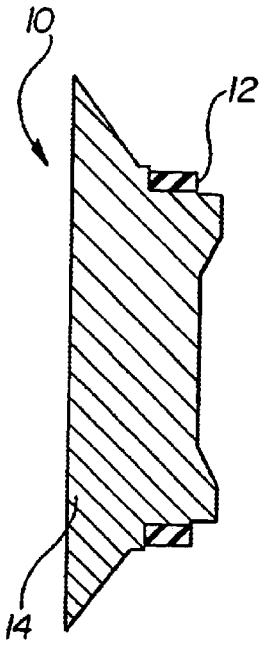
FIG-2
PRIOR ART
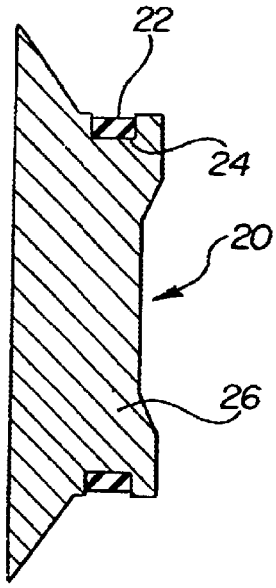
FIG-3
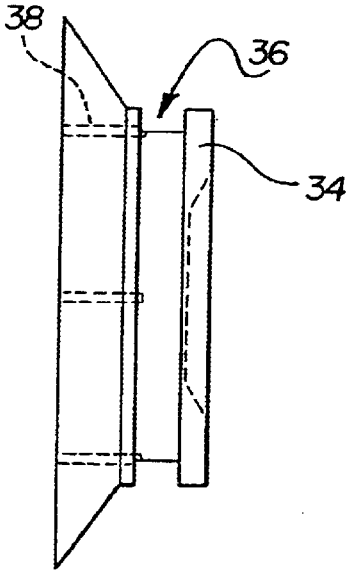
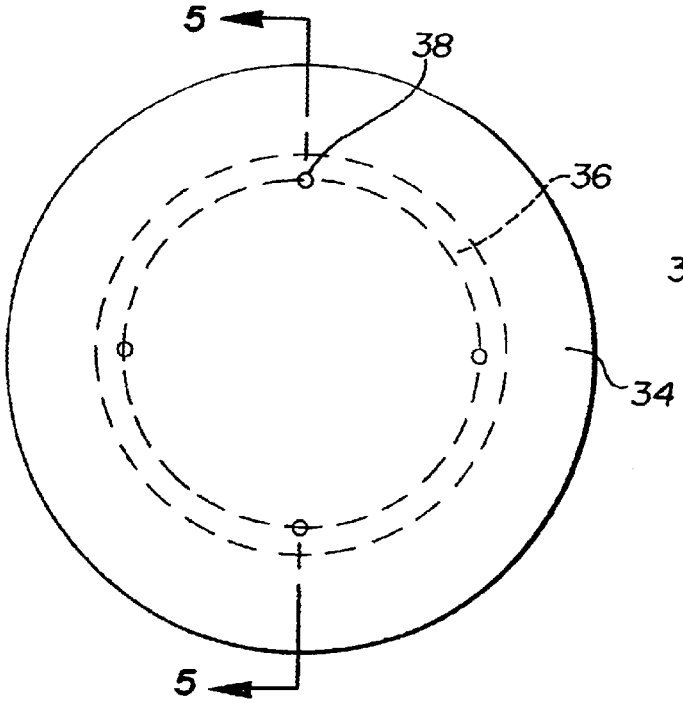
FIG-4
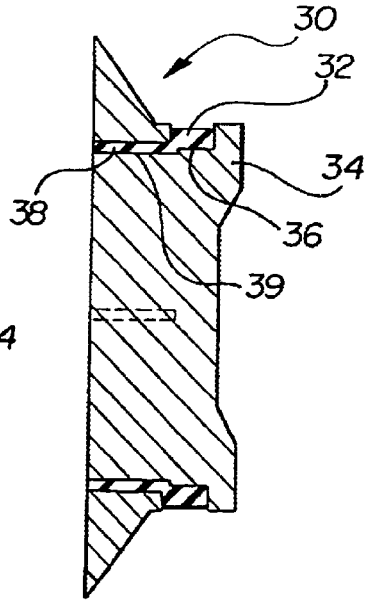
FIG-5

INSERTED MOLDED TRACTION TIRE FOR A MODEL TOY TRAIN

FIELD OF THE INVENTION

The present invention relates to a wheel assembly for a model toy train including traction tire.

BACKGROUND OF THE INVENTION

In the past model toy trains have included traction tires to assist the toy train engines in pulling their respective cars. The traction tires are typically placed on the driven wheels of the model toy train engine. Traction tires prevent the driven wheels from slipping as the model toy train pulls its cars up a slop as is often included in model toy train layouts.

Two styles of traction tires are available in the prior art. As illustrated in FIG. 1 there is shown a prior art toy train wheel assembly 10 including a traction tire 12 directly molded to a die cast wheel 14. Because traction tire 10 did not sit in a channel, strong adhesives were used to bond traction tire 12 to wheel 14. While this design provided increased traction, once the tire 12 wore out the entire assembly 10 had to be disposed of. This was because the material and method used to mold the rubber to the wheel 14 did not allow the traction tire 12 to be removed easily.

The model toy train industry solved the problem of the toy train wheel assembly illustrated in FIG. 1 by replacing the rubber tire 12 of FIG. 1 with the rubber tire 22 as illustrated in FIG. 2. FIG. 2 illustrates a second prior art toy train wheel assembly 20. The rubber tire 22 of FIG. 2 was not molded to a wheel 26 but an undercut recess or channel 24 was provided which accommodated a rubberband-like tire 22. Tire 22 was not bonded to wheel 26, but was held in by the elasticity of tire 22. While the traction tire illustrated in FIG. 2 solved the problem of replacing the tire, it had an undesirous effect that the tire tended to slip off the wheel.

The present invention addresses the problems with the prior art.

SUMMARY OF THE INVENTION

The present invention provides a model toy train wheel assembly including a wheel and a traction tire. The wheel includes an undercut recess accessible by at least one sprue and a traction tire over molded into the undercut recess through the at least one sprue.

The present invention also includes a method for manufacturing a wheel assembly for a model toy train including providing a wheel including an undercut recess and at least one sprue; and over molding an elastomeric tire into the undercut recess through the at least one sprue.

BRIEF DESCRIPTION OF THE DRAWINGS

FIG. 1 is a cut away view of a toy train wheel assembly including a traction tire as found in the prior art.

FIG. 2 is a cut away view of a toy train wheel assembly including traction tire as found in the prior art.

FIG. 3 is a cut away view of a toy train wheel assembly according to the present invention without its corresponding traction tire.

FIG. 4 is plan view of a toy train wheel assembly of FIG. 3.

FIG. 5 is a cut away view of the toy train wheel assembly of FIG. 3 including its corresponding traction tire.

DESCRIPTION OF THE PREFERRED EMBODIMENT

With reference to FIGS. 3 through 5 where like elements are numbered alike, there is shown an inventive toy train wheel assembly including a traction tire. The present toy train wheel assembly includes a recessed channel into which a elastomeric tire, vinyl tire, or the like is over molded into the channel through a plurality of sprues. The elastomeric or vinyl tire acts as a traction tire and is held in place by material which remains in the sprues after the molding process.

With reference to FIG. 5 there is shown a train wheel assembly 30. Assembly 30 includes a wheel 34 and a traction tire 32. Traction tire 32 may be made from any elastomer including rubber or silicone; vinyl, or any material suitable to add traction. Wheel 34 includes an undercut recess 36 and a plurality of sprues 38.

Traction tire 32 is over molded into recess 36 through sprues 38. In short the material which makes up traction tire 32 is injected through sprues 38 and into the undercut recess 36. The undercut recess include a channel having first and second opposing surfaces and a bottom, the surfaces and bottom defining a rectangular cross-section The material which remains in sprues 38 act as fingers 39 which prevent tire 32 from slipping or rotating. By providing a plurality of sprues the present invention provides a solves the problems of the prior art. Unlike the prior art toy train wheel assembly illustrated in FIG. 1, adhesives are not required, although it is understood that the addition of adhesives alone would not avoid the scope of the present invention. Further, unlike the prior art model toy train wheel assembly illustrated in FIG. 2 the traction tire is held on by more than just the elasticity of the traction tire itself.

By over molding traction tire 32 into undercut recess 36 through sprues 38 traction tire 32 does not slip. This is because material from the molding process remains in sprues 38 to form a plurality of fingers 39 which secure traction tire 32 to wheel 34.

In the event that traction tire 32 does become worn it may be easily cut out and replaced with a rubber band type traction tire 22 as was used in the prior art illustrated in FIG. 2. Alternately, a train enthusiast could return the worn out tire to the manufacturer who could easily remove the worn tire 32 and remold a new one thereto.

While the invention has been described in connection with what is presently considered to be the most practical and preferred embodiments, it is to be understood that the invention is not limited to the disclosed embodiments but, on the contrary, it is intended to cover various modifications and equivalent arrangements included within the spirit and scope of the appended claims, which scope is to be accorded the broadest interpretation so as to encompass all such modifications and equivalent structure as permitted under the law.

What is claimed is:

1. A model toy train wheel assembly comprising:

a model toy train wheel including an undercut recess having a channel with at least first and second opposing surfaces accessible by at least one sprue; and a traction tire over molded into the channel of the undercut recess and the at least one sprue.

2. A wheel assembly for a model toy train as in claim 1 including at least 3 sprues.

3. A wheel assembly for a model toy train as in claim 2 wherein the traction tire is made from rubber.

4. The wheel assembly according to claim 1 wherein the first opposing surface is extends along an annular path about a longitudinal axis of the wheel.

5. The wheel assembly according to claim 1 wherein the wheel further comprises:

a frustum portion wherein a narrowest circular cross-section of the frustum portion is closer to the channel than a widest circular cross-section of the frustum portion.

6. The wheel assembly according to claim 1 wherein the traction tire further comprises:

a body; and at least one finger extending from the body disposed in the at least one sprue.

7. The wheel assembly according to claim 1 wherein the traction tire is removably associated with the wheel.

8. The wheel assembly according to claim 1 wherein the first opposing surface is extends along an annular path about a rotational axis of the wheel.

9. The wheel assembly according to claim 1 wherein the channel further comprises:

a third surface opposing the first and second surfaces.

10. A method for manufacturing a wheel assembly for a model toy train comprising:

providing a model toy train wheel including an undercut recess having a channel with at least first and second opposing surfaces accessible by at least one sprue; and over molding a traction tire into the channel of the undercut recess and the at least one sprue.

11. The method according to claim 10 further comprising the step of:

defining a mold cavity with at least two opposing surfaces of the undercut recess of the wheel.

12. The method according to claim 10 further comprising the step of:

dispensing elastomeric material for forming the tire in the at least one sprue before dispensing the elastomeric material in the undercut recess.

13. The method according to claim 10 wherein the over molding step further comprises the step of:

releasibly associating the tire with respect to the wheel.

14. A model toy train wheel assembly comprising:

a model toy train wheel including an undercut recess having a channel with at least first and second opposing surfaces accessible by at least one sprue, the wheel also including a frustum portion wherein a narrowest circular cross-section of the frustum portion is closer to the undercut recess than a widest circular cross-section of the frustum portion; and a traction tire over molded into the channel of the undercut recess and the at least one sprue.

15. The wheel assembly according to claim 14 wherein the at least one sprue extends through the wheel along a path substantially parallel to a longitudinal axis of the wheel.

16. The wheel assembly according to claim 14 wherein the at least one sprue pierces the frustum portion of the wheel.

17. The wheel assembly according to claim 14 wherein the wheel further comprises:

a cylindrical portion adjacent the frustum portion, the undercut recess formed in the cylindrical portion.

18. The wheel assembly according to claim 17 wherein the channel of the undercut recess further comprises:

a rectangular cross-section.

* * * * *